US007410938B2

(12) United States Patent
Brennan

(10) Patent No.: US 7,410,938 B2
(45) Date of Patent: Aug. 12, 2008

(54) CALCIUM HYPOCHLORITE/SCALE INHIBITOR/RESIDUE DISPERSER TRIBLEND

(75) Inventor: James P. Brennan, Ooltewah, TN (US)

(73) Assignee: Arch Chemicals, Inc., Norwalk, CT (US)

( * ) Notice: Subject to any disclaimer, the term of this patent is extended or adjusted under 35 U.S.C. 154(b) by 0 days.

(21) Appl. No.: 11/063,004

(22) Filed: Feb. 22, 2005

(65) Prior Publication Data

US 2005/0187120 A1 Aug. 25, 2005

Related U.S. Application Data

(60) Provisional application No. 60/547,592, filed on Feb. 24, 2004.

(51) Int. Cl.
*C11D 3/395* (2006.01)
*C11D 7/16* (2006.01)

(52) U.S. Cl. ..... 510/380; 510/218; 510/224; 510/231; 510/247; 510/445; 510/453; 510/446; 510/510; 510/512; 510/534; 510/367; 510/379

(58) Field of Classification Search ..... 510/218, 510/224, 231, 247, 445, 453, 446, 510, 512, 510/534, 367, 379, 380
See application file for complete search history.

(56) References Cited

U.S. PATENT DOCUMENTS

| | | | | | |
|---|---|---|---|---|---|
| 3,154,495 | A | | 10/1964 | Robson et al. | 252/99 |
| 3,604,020 | A | * | 9/1971 | Moisa | 4/227.1 |
| 3,639,284 | A | * | 2/1972 | Long et al. | 252/187.29 |
| 3,668,134 | A | | 6/1972 | Lamberti et al. | |
| 3,669,891 | A | | 6/1972 | Greenwood et al. | |
| 3,793,216 | A | * | 2/1974 | Dychdala et al. | 252/186.37 |
| 3,969,546 | A | | 7/1976 | Saeman | |
| 4,005,027 | A | * | 1/1977 | Hartman | 510/369 |
| 4,005,028 | A | | 1/1977 | Heckert et al. | |
| 4,048,351 | A | | 9/1977 | Saeman et al. | |
| 4,051,056 | A | * | 9/1977 | Hartman | 510/369 |
| 4,071,605 | A | | 1/1978 | Wojtowicz | |
| 4,118,524 | A | | 10/1978 | Saeman | |
| 4,146,676 | A | | 3/1979 | Saeman et al. | |
| 4,174,411 | A | | 11/1979 | Saeman et al. | |
| 4,201,756 | A | | 5/1980 | Saeman et al. | |
| 4,216,027 | A | | 8/1980 | Wages | |
| 4,289,640 | A | | 9/1981 | Falivene | |
| 4,380,533 | A | | 4/1983 | Wojtowicz | |
| 4,460,490 | A | | 7/1984 | Barford et al. | 252/92 |
| 4,539,179 | A | * | 9/1985 | Meloy | 422/28 |
| 4,615,794 | A | | 10/1986 | Belanger | |
| 4,668,475 | A | | 5/1987 | Meloy | |
| 4,876,003 | A | | 10/1989 | Casberg | 210/169 |
| 4,931,207 | A | | 6/1990 | Cramer et al. | |
| 5,610,126 | A | | 3/1997 | Barford et al. | |
| 5,707,534 | A | | 1/1998 | Del Corral et al. | |
| 5,756,440 | A | | 5/1998 | Watanabe et al. | |
| 5,888,528 | A | | 3/1999 | Wellinghoff et al. | |
| 5,914,040 | A | | 6/1999 | Pescher et al. | |
| 5,958,853 | A | | 9/1999 | Watanabe | |
| 6,863,830 | B1 | * | 3/2005 | Purdy et al. | 210/756 |
| 7,045,077 | B2 | | 5/2006 | Garris | 252/186.37 |

FOREIGN PATENT DOCUMENTS

| | | | |
|---|---|---|---|
| WO | 99/29632 | * | 6/1999 |
| WO | WO99/29632 | | 6/1999 |
| WO | WO 2006/009554 A1 | | 1/2006 |

* cited by examiner

*Primary Examiner*—Charles I Boyer
(74) *Attorney, Agent, or Firm*—Todd E. Garabedian; Wiggin and Dana LLP

(57) ABSTRACT

A solid calcium hypochlorite composition comprising a mixture of: solid calcium hypochlorite; a scale-inhibiting effective amount of a primarily scale-inhibiting alkali metal phosphate; and an effective residue-dispersing amount of primarily residue-dispersing alkali metal phosphate.

13 Claims, No Drawings

CALCIUM HYPOCHLORITE/SCALE INHIBITOR/RESIDUE DISPERSER TRIBLEND

CROSS-REFERENCE TO RELATED APPLICATIONS

This application claims the benefit of U.S. Provisional Application No. 60/547,592 filed Feb. 24, 2004.

BACKGROUND OF THE INVENTION

1. Field of the Invention

The present invention relates to blends of calcium hypochlorite with at least one condensed phosphate that is useful as scale-inhibitor and at least one condensed phosphate that is useful as a residue disperser. In particular, a preferred embodiment of this invention relates to homogeneous blends with calcium hypochlorite with sodium tripolyphosphate (STPP) and sodium hexametaphosphate (SHMP).

2. Brief Description of Art

Calcium hypochlorite is a commonly used chlorine compound that is highly effective against bacteria, algae, slime, fungi and other harmful microorganisms. Its primary use is chlorinating swimming pool, spa and hot tub water. Additionally, calcium hypochlorite is used to treat water supplies and sewage. Calcium hypochlorite is also used in cleansing compositions for bathroom and kitchen use.

The most popular form of calcium hypochlorite when used for chlorination is tablets or granules. However, calcium hypochlorite can also be formed into briquettes, pellets, or can be put into solution. Typically, the tablets, granules, and the like, are inserted into a chlorination unit that is attached to the body of water to be chlorinated. The water is passed through the chlorination unit where the calcium hypochlorite dissolves upon contact with the water.

Despite its popularity, there are drawbacks when calcium hypochlorite is used in water chlorination. For instance, when calcium hypochlorite is dissolved in water, calcium ions are released which can form calcium carbonate in solution. When the alkalinity level of the water becomes high, calcium carbonate is likely to precipitate from solution in the form of hard surface scale deposits and also form suspended solid residues.

Such scale deposits can partially or totally block passages in the chlorination unit and its outlets. Blockage of these passages reduces the amount of chlorinating agent that ultimately reaches the body of water. Ultimately the water is not properly chlorinated which may lead to microorganism build up in the water. High microorganism amounts are sought to be avoided due to the known harms to humans and animals.

Typically, to remove scale deposits, a strong mineral acid such as hydrochloric acid is applied to the affected surfaces. This application may be required up to twice a week depending on the volume of water being chlorinated and its pH. This technique is time consuming, laborious and is not cost effective.

It is known in the art that the addition of a certain alkali metal phosphates to calcium hypochlorite prevents some scale deposits. Scale inhibitors have been blended with calcium hypochlorite. However, the use of a scale inhibitor with calcium hypochlorite could result in the suspension of more residues. For example, when a scale inhibitor is used to remove scale deposits from affected surfaces, more small particles are created. Consequently, these small particles may agglomerate and may plug small openings that are nearby.

Therefore, what is needed in the art is a composition that treats or prevents scale deposits while also keeping suspended residues from agglomerating. Most preferably, what is needed in the art is a composition that both treats or prevents scale deposits and also prevents small particles from thereafter agglomerating and plugging up small openings.

It is noted that various alkali metal phosphates have been added to calcium hypochlorite for a variety of reasons. Depending on the use of the end product, phosphates have been added for a sequestering effect, to assist in the cleansing action, or to inhibit scale formation.

More specifically, products have been developed that incorporate an amount of alkali metal phosphate with the calcium hypochlorite to achieve stronger cleansing results or scale inhibiting results. Unfortunately to achieve these results, a large amount of alkali metal phosphate salts are usually added. Examples of prior art references teaching adding phosphates to calcium hypochlorite include the following:

U.S. Pat. No. 3,154,495 relates to mixtures of calcium hypochlorite with various alkali metal salts such as phosphates. The examples provide teachings of certain blends that employ in excess of 30% of phosphate in the calcium hypochlorite blend.

U.S. Pat. No. 3,639,284 relates to bleaching compositions diluent salts in particulate form and in specified ratios to form homogeneous granules. The weight ratio of the STPP to calcium hypochlorite is not be less than 2.9 parts of STPP per part of calcium hypochlorite and not more than 8.6 parts of STPP per part of calcium hypochlorite. These ratios are preferred in order to maintain the available chlorine content of the product at convenient levels.

U.S. Pat. No. 3,793,216 relates to a calcium hypochlorite composition containing at least about 55% calcium hypoclhlorite uniformly mixed with water-soluble hydrated inorganic salt. The inorganic salt would be a quantity sufficient to provide a water content for 3% to 11% in the total mixture. An example of an inorganic salt in this patent was sodium tripolyphosphate hexahydrate (STPP.6$H_2O$). This patent teaches that the hydrated inorganic salts may be present in amounts from 5 to 20% by weight of the mixture.

U.S. Pat. No. 4,460,490 relates to a layered cleansing block composition containing a bleaching agent such as calcium hypochlorite in an inner layer. The cleansing block also includes a water-softening agent such as STPP or SHMP. The phosphates may constitute 10% to 50% of the total cleaning composition.

PCT application No. WO 99/29632 relates to a calcium hypochlorite composition comprising a mixture of calcium hypochlorite and a scale-inhibiting amount of a solid alkali metal phosphate. Examples of the phosphates include tripolyphosphate, pyrophosphate, trimetaphosphate, hexametaphosphate or mixtures of such phosphates. The only experiments in this PCT application employed STPP. The phosphate may be present in amounts from about 0.05% to 4% by weight of the total weight of the composition.

Ideally, it is desired to have a calcium hypochlorite composition that includes one additive to prevent or inhibit scale formation and further contains another additive to aid in dispersing suspended residues. These ideal additives would be inexpensive, easily manufactured and would not interfere with calcium hypochlorite's properties. The present invention provides an answer to this desired composition.

BRIEF SUMMARY OF THE INVENTION

It has been surprisingly found that calcium hypochlorite can be directly blended with a combination of two or more alkali metal phosphates such as SHMP and STPP to form a mixed solid composition. This solid composition reduces scale deposition and aids in dispersing insoluble residues without interfering with any of calcium hypochlorite's properties.

Therefore, one aspect of the present invention is directed to a solid calcium hypochlorite composition comprising a mixture of solid calcium hypochlorite and an effective scale-inhibiting amount of a primarily scale-inhibiting alkali metal phosphate (e.g. STPP) and an effective residue-dispensing amount of a primarily residue-dispersing alkali metal phosphate (e.g. SHMP).

Another aspect of the present invention is directed to a solid shaped calcium hypochlorite article comprising a mixture of solid calcium hypochlorite and an effective scale-inhibitor amount of a primarily scale-inhibiting alkali metal phosphate and an effective residue-dispersing amount of a primarily residue-dispersing alkali metal phosphate.

One advantage of the present invention includes reduced scale deposits and blocked passageways of filters and the like, when the present invention is used in water treatment applications in which feeding equipment is employed, such as swimming pools, drinking water, waste and industrial water treatment and the like. Another advantage of the present invention includes the use of pre and/or post-harvest washing of fruits and vegetables. Additionally, the present invention can be used in other applications involving food contact such as washing of meat, poultry, and fish and meat processing equipment as well as agricultural irrigation equipment and the like.

DETAILED DESCRIPTION OF THE INVENTION

The solid calcium hypochliorite composition of the present invention comprises a solid calcium hypochlorite component with two condensed phosphate components as the (3) three essential ingredients.

The solid calcium hypochlorite component is commercially available and typically contains at least 55 weight percent available chlorine. Preferably, commercial calcium hypochlorite product such as HtH® and CCH® products available from Arch Chemicals, Inc. of Norwalk, Conn. have a minimum available chlorine content ranging from about 65 weight percent to about 75 weight percent. The remainder of such commercially available calcium hypochlorite products usually consists of water and inorganic calcium and alkali metal salts. Typically, the salts present include sodium chloride, calcium chloride, calcium hydroxide and the like.

The calcium hypochlorite component in this solid calcium hypochlorite composition of the present invention is preferably at least about 95% of the total weight of these three essential ingredients. More preferably, the calcium hypochlorite component is about 98% to about 99.8% of the total weight of these three essential ingredients. Most preferably, the calcium hypochlorite component is from about 98.5% to about 99.5% of the total weight of these three essential ingredients.

The second essential component of the present invention is at least one primarily scale-inhibiting alkali metal phosphate. This second component is present in the mixture in an effective scale-inhibiting amount. The alkali metal of the solid alkali metal phosphate may be lithium, sodium or potassium. Preferably the alkali metal is either potassium or sodium. Most preferably, the alkali metal in the present invention is sodium, but potassium salt may be also suitable for some applications. The term "effective scale-inhibiting amount" means an amount of alkali metal phosphate that is sufficient to inhibit or minimize scale deposition onto surfaces. More preferably the "effective scale-inhibiting amount" means an amount that will prevent the scale deposition onto surfaces. The preferred primarily scale-inhibiting alkali metal phosphate is an alkali metal tripolyphosphate such as sodium tripolyphosphate (STPP). Other condensed phosphates that are known to have primarily scale-inhibiting properties may be used.

The one or more primarily scale-inhibiting alkali metal phosphate such as STPP is typically present in the solid calcium hypochlorite composition in an amount of at least 0.1% but not more than 4.5% by weight, based on the weight of the three essential components. More preferably, each scale-inhibiting alkali metal phosphate is present in an amount of from 0.2% to 1.0% by weight, based on the total weight of the three essential ingredients. Most preferably, each primarily scale-inhibiting alkali metal phosphate is present in an amount of about 0.5% by weight based on the total weight of the three essential components.

The third essential component of the present invention is a residue-dispersing alkali metal phosphate. This component is present in the mixture in an effective residue-dispersing amount. The alkali metal of the solid alkali metal phosphate may be lithium, sodium or potassium. Preferably, the alkali metal is either potassium or sodium. Most preferably, the alkali metal in the present invention is sodium, but potassium salt may be also suitable for some applications. The term "residue-dispersing amount" means an amount of alkali metal phosphate that is sufficient to prevent small residue particles in solution from agglomerating. The preferred primarily residue-dispersing alkali metal phosphate is an alkali metal hexametaphosphate such as sodium hexametaphosphate. Other condensed phosphates that are known to have primarily residue-dispersing properties may also be used.

Each solid primarily residue-dispersing alkali metal phosphate is typically present in the solid calcium hypochlorite composition in an amount of at least 0.1% but not more than 4.5% by weight, based on the total weight of the three essential components. More preferably, each primarily residue-dispersing alkali metal phosphate is present in an amount of at least 0.2% but not more that 1.0% by weight, based on the total weight of the three essential components. Most preferably, each primarily residue-dispersing solid alkali metal phosphate is present in an amount no less or more than 0.5% by weight, based on the total weight of these essential components.

In the preferred embodiment of this invention, two solid alkali metal phosphates are homogeneously mixed with the solid calcium hypochlorite. The preferred solid alkali metal phosphates are sodium tripolyphosphate (STPP) and sodium hexametaphosphate (SHMP). The preferred weight ratio of STPP to SHMP is from 9:1 to 1:9 by weight. More preferably the weight ratio is 3:1 to 1:3 by weight.

Solid calcium hypochlorite compositions according to the present invention may also contain additives that do not interfere with the sanitizing scale-inhibiting and residue-dispersing characteristics of the composition. These additives include but are not limited to pigments, dyes, dissolution rate modifiers, binders, lubricants, color-containing salts, and the like. These additives may be pre-blended with either phosphate component or the calcium hypochlorite component added to the triblend mixture. Additionally, inert by-products such as water or lime, that result from the manufacturing process of the calcium hypochlorite, may be present in the composition.

The making of the solid calcium hypochlorite composition of the present invention can be accomplished by several different methods. For example, tumble blenders, v-blenders, ribbon blenders and the like may be used in a batch mode to blend the composition of the present invention. Additionally, screw augurs, conveyers, and the like may be used in a continuous mode to blend the composition. Both the scale inhibiting alkali metal and the residue-dispersing alkali metal phosphate may be added to the calcium hypochlorite individually. Alternatively, the solid alkali metal phosphates can be blended together before addition to the calcium hypochlorite. If the phosphates are pre-blended, an identifying component such as a color pigment or dye may be added to the phosphates.

Alternatively, the composition may be formed into a layered or homogeneously mixed solid shaped article. The composition of the present invention may be formed into a variety of solid shaped articles. These shaped articles include, but are not limited to tablets, bricks, briquettes, pellet, granules, and the like.

The solid shaped articles of the present invention may be made from the three critical components (with or without an additive) according to any conventional tabulating process or equipment normally used to make calcium hypochlorite-containing tablets or other solid shaped articles. Specifically, any suitable equipment that produces molded compacted products such as tablets, or caplets or briquettes, or other known products, using blends of the present invention may be used. Any shape or size tablet may be used. One preferred form of a tablet is shown in U.S. Pat. No. 4,876,003. Tablets of that cylindrical shape are about 4 inches in length and about 1 inch in diameter. Other preferred forms are puck-shaped tablets that are 3.5 inches in diameter and from 1 inch to 1.25 inches in length or briquettes (7 grams in weight) that are 1.25 inches in length, 0.75 inches in width, and 0.5 inches in thickness. Preferred tabletting equipment includes hydraulic presses (such as Hydration or Bipel hydraulic presses) or briquetting apparatus (such as a Bepex Compactor). Any suitable dwell times and pressures may be used in operating such hydraulic presses.

The solid calcium hypochlorite composition of the present invention may be used in chlorination of swimming pools, spas, or hot tubs. The solid calcium hypochlorite composition of the present invention can be added directly to a chlorination unit that is attached to the body of water that is sought to be chlorinated. When used in such a manner, the solid calcium hypochlorite composition dissolves and is dispersed into the body of water when it is contacted with a stream of water. When using the solid calcium hypochlorite composition to clean surfaces with scale deposits the composition may put in solution and sprayed on to the surface, or the surface may be wiped with a soaked rag, or the surface may be immersed in the solution.

Additionally, the present invention can be used in pre and/or post-harvest washing of fruits and vegetables as well as washing meat, poultry and fish and meat processing equipment. Washing of these articles may be performed by placing the composition in solution and using one of the methods described above.

The following Example further illustrates the present invention. All parts and percentages are by weight unless stated otherwise.

EXAMPLE

Twenty pounds of sodium tripolyphosphate and 20 pounds of sodium hexametaphosphate were blended together into a rotary baffled drum for 80 revolutions. The resulting blended material was bagged. The bagged phosphate material was then blended with a calcium hypochlorite granular product available from Arch Chemicals (DryTec brand) in the feed stream of a Bepex Compactor Model 75MS-20.5 Compactor briquetting apparatus. The amount of total blended phosphates in this briquetted triblend product was about 1% by weight rate.

A sample of this blended feed stream was analyzed for phosphate content and was found to contain 1.18% phosphates by weight.

A sample of briquetted triblend material (as well as a pure calcium hypochlorite briquette control) was tested. Each sample of briquettes (8 briquettes) were placed in water at room temperature for 20 hours to measure their disintegration property. It was found that the sample of the present invention had essentially the same disintegration property as the control.

Calcium Carbonate Precipitate Particle Size Experiment

Two batches of briquettes were made according to the process of the preceding Example. One batch was made from an Arch Chemical 68% by weight calcium hypochlorite granular product with 0.5% by weight sodium tripolyphosphate and 0.5% by weight sodium hexametaphosphate added. The second batch contained the same calcium hypochlorite material and only 0.5% by weight sodium tripolyphosphate added (no sodium hexametaphosphate).

Briquettes from each batch were then crushed separately using a mortar and pestle.

One gram samples of each ground mixture were combined with 100 milliliters of water containing about 200 ppm of alkalinity (expressed as calcium carbonate) to produce approximately 1% solutions of each batch.

The particle size distribution of the calcium carbonate precipitated particles of both solutions was measured using a Horiba Model LA-910 laser scattering particle size distribution analyzer. The data from those measurements showed that the addition of the sodium hexametaphosphate to the other two ingredients effectively reduced the particle size of the resulting calcium carbonate particles as evidenced by a 30% increase in the number of particles less than one micron in size compared to the sample not containing the SHMP. Also, the addition of SHMP virtually eliminated the 23% of particles greater than 10 microns in size that were present in the other sample with sodium triphosphate alone. This reduction in particle size with SHMP present is interpreted to indicate its addition results in a reduction in the tendency to agglomerate as well as increasing the ability to keep calcium carbonate particles in suspension, thus reducing the chance of plugging small openings in pool feeder components.

While the invention has been described above with reference to specific embodiments thereof, it is apparent that many changes, modifications, and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A solid calcium hypochlorite composition comprising a mixture of:

solid calcium hypochlorite;

about 0.1 to about 4.5 wt % of sodium tripolyphosphate (STPP); and about 0.1 to about 4.5 wt % of sodium hexametaphosphate (SHMP), said weight percents being based on the total weight of said composition.

2. The solid calcium hypochlorite composition of claim 1 wherein the mixture is a homogenous mixture.

3. The solid calcium hypochlorite composition of claim 1, wherein both STPP and SHMP are each present in an amount of from 0.2% to 1.0% by weight, based on the total weight of the composition.

4. The solid calcium hypochlorite composition of claim 3, wherein said STPP and said SHMP are each present in an amount of 0.5% by weight, based on the total weight of the composition.

5. A solid shaped article comprising a mixture of:

solid calcium hypochlorite;

about 0.1 to about 4.5 wt % of sodium tripolyphosphate (STPP); and about 0.1 to about 4.5 wt % of sodium hexametaphosphate (SHMP), said weight percents being based on the total weight of said composition.

6. The solid shaped article of claim 5, wherein the three components are present in distinct layers.

7. The solid shaped article of claim 5, wherein said mixture is a homogenous mixture.

8. The solid shaped article of claim 5, wherein said article is in the form of a tablet.

9. The solid shaped article of claim 5, wherein said article is in the form of granules.

10. The solid shaped article of claim 5, wherein said article is in the form of a briquette.

11. The solid shaped article of claim 5, wherein said article is in the form of pellets.

12. The solid shaped article of claim 5 wherein said STPP and said SHMP are each present in an amount from 0.2% to 1.0% by weight, based on the total weight of the mixture.

13. The solid shaped article of claim 12, wherein said STPP and the SHMP are each present in an amount of 0.5% by weight, based on the total weight of the mixture.

* * * * *